United States Patent [19]

Springer et al.

[11] Patent Number: 4,767,131

[45] Date of Patent: Aug. 30, 1988

[54] UTILITY CLAMP

[75] Inventors: Thomas W. Springer, Landenberg; Raymond L. Slavinski, Birchrunville; Ronald H. Laird, Lincoln University, all of Pa.

[73] Assignee: SLS Products, Inc., Avondale, Pa.

[21] Appl. No.: 40,888

[22] Filed: Apr. 21, 1987

[51] Int. Cl.[4] ..... A47C 7/62

[52] U.S. Cl. ..... 280/289 WC; 248/316.2; 269/231; 297/188

[58] Field of Search ..... 280/289 WC; 248/316.2; 297/188, DIG. 4; 269/229, 231

[56] References Cited

U.S. PATENT DOCUMENTS

| | | | |
|---|---|---|---|
| 442,629 | 12/1890 | Lipscomb | 297/191 |
| 630,900 | 8/1899 | Kohl | 269/231 |
| 3,709,556 | 1/1973 | Allard et al. | 248/125 |
| 3,850,399 | 11/1974 | McClymont et al. | 248/316.2 |
| 4,176,817 | 12/1979 | Jones | 248/316.2 |
| 4,190,224 | 2/1980 | LeBlanc et al. | 248/229 |
| 4,431,206 | 2/1984 | Pryor | 280/289 WC |
| 4,511,157 | 4/1985 | Wilt, Jr. | 280/289 WC |
| 4,511,158 | 4/1985 | Varga et al. | 280/289 WC |
| 4,572,536 | 2/1986 | Doughty | 280/289 WC |
| 4,606,209 | 7/1986 | Kerr, Jr. | 280/289 WC |

FOREIGN PATENT DOCUMENTS

| | | | |
|---|---|---|---|
| 929554 | 12/1947 | France | 269/231 |

*Primary Examiner*—John J. Love
*Assistant Examiner*—Eric D. Culbreth
*Attorney, Agent, or Firm*—Woodcock Washburn Kurtz Mackiewicz & Norris

[57] ABSTRACT

Clamps for securing rollable devices such as utility poles to vehicles such as patient transportation vehicles are disclosed. In accordance with preferred embodiments, the clamp is comprised of mounting plate, leg guide, receiving pocket and variable cam for securing the utility pole to the patient transportation vehicle. The variable cam is preferably comprised of a section of an ellipsoidal solid surrounded by a bezel. The weight of a lever which rotates the variable cam is used to secure the variable cam and secure a utility pole within the pocket. The mounting plate of the clamp has multiple mounting locations such that the clamp can be used with numerous transportation vehicles and may be attached in various positions.

8 Claims, 2 Drawing Sheets

UTILITY CLAMP

This invention is directed to clamps for securing rollable devices such as hospital utility poles to wheeled vehicles such as patient transportation vehicles. In preferred embodiments, the invention is directed to clamps utilizing variable cams to secure the rollable devices on utility poles so that the pole and the vehicle move in tandem. A preferred application of the invention is in emergency medical situations where a technician or orderly must mount an intravenous pole to a wheelchair and move the combination, along with a patient, in an expedient fashion to a treatment or diagnosis area of a hospital.

BACKGROUND OF THE INVENTION

Present day hospital transportation vehicles for injured or ill patients often require the transporting of accessory equipment necessary to sustain the patient. Typically, the accessory equipment is hung from a utility pole through hangar and hook devices. See, e.g., U.S. Pat. No. 3,709,556—Allard et al. The pole, along with the accessory equipment, must then be moved along with the transportation vehicle. Thus, an orderly or other attendant must move the combination in tandem. This is inconvenient at best. See, for example, U.S. Pat. No. 4,511,158—Varga et al and U.S. Pat. No. 4,572,536—Doughty. Both of these systems are cumbersome and require a great deal of attention from the orderly during their operation. Thus, it is desirable that means be attained for attaching utility poles to vehicles through a firm and sturdy mechanical connection so that an orderly or attendant is able to devote full attention to the patient. It is greatly desired that such means be amenable to widely varying types of equipment so that one device or system will be effective for attaching varying types of poles or other objects to the vehicles. This would facilitate safe and efficient transportation of the patient and his life-sustaining accessories in emergency situations with disparate equipment.

While such approaches have been tried in the past, they have not met with wide acceptance. A long-felt need for efficient clamping systems thus still exists. A typical prior approach has been to provide a female mounting sleeve attached to a wheelchair and a male extension attached to the intravenous pole. See, e.g., U.S. Pat. No. 4,511,157—Wilt, Jr. The two parts are then fitted together and secured by a threaded screw. This provides an unreliable mechanical connection which requires too much time and effort to perform. It does not provide the desired flexibility to use the clamping means to secure different size utility poles interchangeably. This arrangement also requires an orderly or attendant to divert considerable attention away from the patient to perform this function. Furthermore, utilization of a threaded screw clamp is unreliable because of the tendency of the threaded screw to loosen as an orderly or attendant rapidly moves the patient throughout the hospital in the quest for emergency medical care. A device which utilizes a threaded screw clamp to secure a utility pole to a patient transportation vehicle is disclosed in U.S. Pat. No. 4,431,206—Pryor. The method of securing utility poles to patient transportation vehicles disclosed in U.S. Pat. No. 4,431,206—Pryor is cumbersome and inefficient.

Therefore, there is a continuing need in this art for a clamping system for reliably connecting rollable devices such as hospital utility poles to wheeled vehicles such as patient transportation vehicles. This need requires a clamping means which allows fast and efficient attachment of, for example, utility poles of variable size and which can be used with different types of hospital transportation vehicles. Means for attaching utility poles of variable size has been disclosed in U.S. Pat. No. 4,190,224—LeBlanc et al. However, the device therein disclosed utilizes a threaded screw clamp to adjust a pair of substantially perpendicular plates to secure the utility pole and is therefore inefficient and cumbersome and does not fulfill the long-felt need for a utility pole clamp that secures a utility pole to a patient transportation vehicle in an expedient and efficient manner. Cam means to secure a child's toys of various sizes to a chair has been disclosed in U.S. Pat. No. 442,629—Lipscomb. However, the device described therein does not disclose a means for attaching rollable devices such as utility poles to vehicles such as patient transportation vehicles and does not satisfy the long-felt need present in the field today to accomplish this task.

SUMMARY OF THE INVENTION

In accordance with this invention, there are provided clamps comprising a mounting plate which attaches to a vehicle such as a patient transportation vehicle in a convenient location. A variable cam rotatable from an open to a closed position and from a closed to an open position is connected to the plate such that a rollable device such as a utility pole can be secured to the plate with a sturdy mount by the cam. The cam is rotated such as by a lever which requires only one-handed operation and can be operated quickly so that a hospital orderly or attendant need not divert attention away from the patient. Preferably, the weight of the lever secures the cam in position although other means such as resilient means may do so. The clamp also preferably contains a guide for the legs of the utility pole to facilitate efficient movement in tandem with the patient transportation vehicle.

It is an object of the present invention to provide a hospital utility pole clamp of lightweight material and unitary construction.

It is a further object of the present invention to provide a hospital utility pole clamp to be utilized with existing patient transportation vehicles with little or no modification of the existing vehicles.

It is a further object of the present invention to provide a hospital utility pole clamp which can be operated with one hand in a quick manner so that the hospital attendant or orderly need not divert his attention away from the patient for any length of time.

It is a further object of the present invention to provide a variable cam for securing different sized and shaped hospital utility poles for different applications to the patient transportation vehicles.

It is a further object of this invention to provide a secure and reliable frictional mechanical connection of the utility pole to the mounting plate by means of the variable rotatable cam means.

It is a further object of this invention to utilize the weight of a lever that is used to rotate variable cam means to secure the cam into position such that a reliable frictional mechanical connection of the utility pole to the mounting plate is accomplished.

It is a further object of this invention to allow a hospital attendant or orderly to move the utility pole and patient transportation vehicle in tandem such that the attendant or orderly is able to simultaneously control the utility pole and vehicle without diverting his attention from the patient.

The foregoing and other objects and features of the present invention will be better understood from the following more detailed description and appended claims.

DETAILED DESCRIPTION OF THE INVENTION

Figure 1:
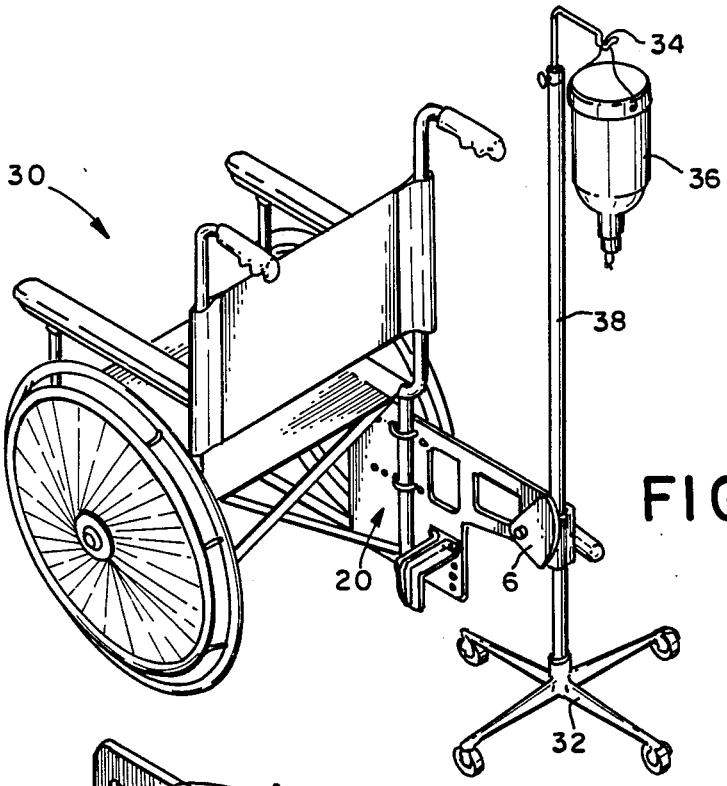
FIG. 1 is a perspective view of a clamp of this invention used in conjunction with a hospital utility pole and a wheelchair.

FIG. 1 is a perspective view of a hospital utility pole clamp in accordance with a preferred embodiment of this invention shown generally, 20 showing the clamp mounted to a wheelchair shown generally, 30. A hospital utility pole shown generally at 38 is attached to the clamp 20 by a frictional mechanical connection that is provided by the variable cam, 6. A hangar shown generally at 34 from which an intravenous bottle hangs, is frequently an integral part of the utility pole 38. The utility pole 38, when secured to the wheelchair 30 by the clamp 20, rolls in tandem with the wheelchair 30 on wheeled legs, 32.

Figure 2:
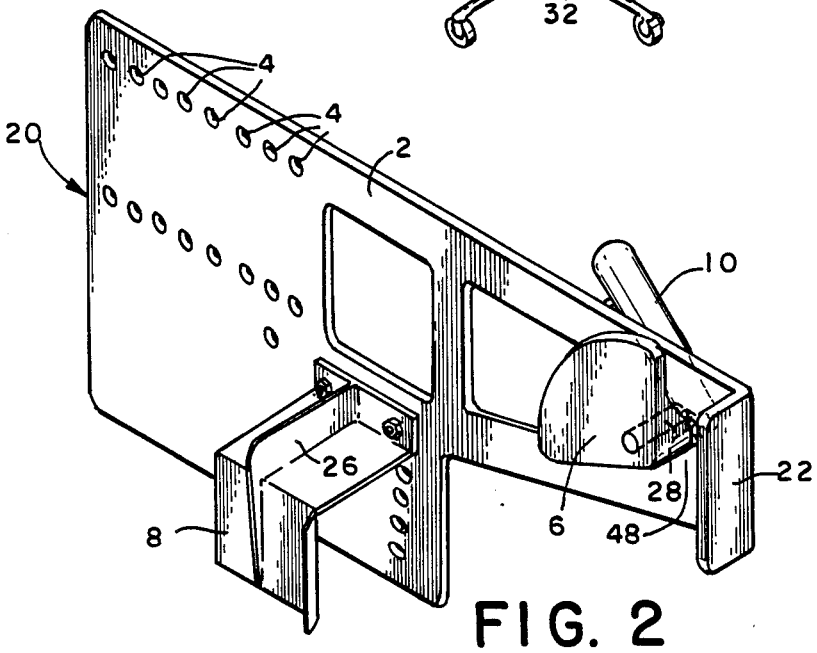
FIG. 2 is a perspective view of a hospital utility pole clamp.

FIG. 2 is a perspective view of the hospital utility pole clamp 20. In this embodiment, multiple mounting locations 4 are perforated in the mounting plate 2. The multiple mounting locations 4 allow freedom in attaching the clamp 20 to a variety of patient transportation vehicles in a number of positions. A hospital utility pole leg guide shown generally at 8 is attached to the mounting plate 2 and provides a means to contain the wheeled leg of a hospital utility pole. The hospital utility pole leg guide 8 is preferably strengthened by reinforcement means such as a rib 26 which is attached to the top of the leg guide 8 and runs its length.

Variable cam 6 is shown attached to shaft 28. Attached to the side of the shaft 28 opposite the side where the variable cam 6 is attached is a lever 10 used to rotate the shaft 28 and cam 6 combination such that the cam 6 can create a frictional mechanical connection of the utility pole with the clamp 20. In this embodiment, the weight of lever 10 is used to hold the variable cam 6 in place against the hospital utility pole. Other means for accomplishing this function such as resilient means are also comprehended hereby. In this embodiment, attached to the mounting plate 2 is a sidewall 22 which is substantially perpendicular to the mounting plate 2. The perpendicular sidewall 22 and mounting plate 2 form a pocket 48 which receives a rollable article such as a hospital utility pole. The variable cam 6 and lever 10 combination rotates to open and close the pocket 48 after it is occupied by the hospital utility pole.

Figure 3:
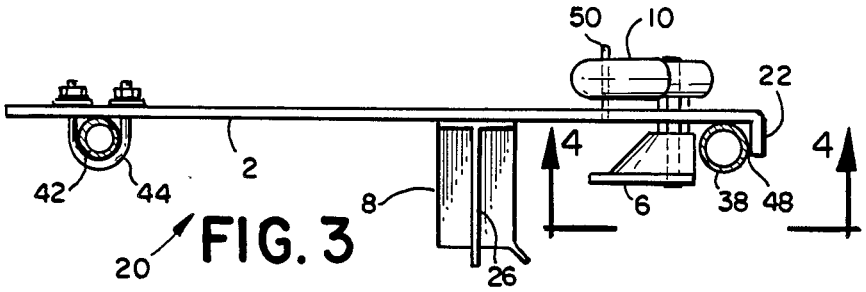
FIG. 3 is an elevation view of the hospital utility pole clamp attached to a support member of a hospital transportation vehicle.

Referring now to FIG. 3, the hospital utility pole clamp 20 is pictured in an elevation view. The clamp is attached to a support member of a hospital transportation vehicle 42. Means for securing the clamp 20 to the support member 42 are shown generally at 44. The leg guide 8 is shown in this embodiment integrally attached to the mounting plate 2. A reinforcing rib 26 runs dorsally along the leg guide 8 and provides support strength for the leg guide 8.

In a preferred embodiment a sidewall 22 which is substantially perpendicular to the mounting plate 2 forms a utility pole receiving pocket shown generally at 48. When the variable cam 6 is rotated into a closed position, the utility pole 38 is secured in the utility pole receiving pocket 48 by a frictional connection and the utility pole 38 substantially fills the pole receiving pocket 48. When the variable cam 6 is in the open position, lever 10 rests upon lever stop 50. When the variable cam 6 is rotated into the closed position securing the utility pole 38 within the pole receiving pocket 48, the weight of lever 10 provides a secure mechanical connection.

Figure 4A:
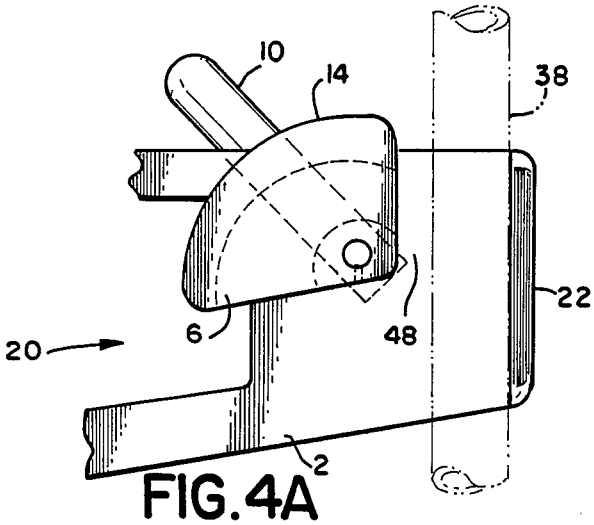
FIG. 4A is a detailed plan view showing the variable cam, rotating lever, utility pole and the utility pole receiving pocket cut along line 4—4 of FIG. 3 when the variable cam is in the open position.

FIG. 4A is a detailed plan view of the hospital utility pole clamp 20 cut along line 4—4 of FIG. 3. In FIG. 4A, variable cam 6 is shown in the open position and is held in place by the weight of lever 10. Sidewall 22 and mounting plate 2 form the pole receiving pocket 48 in which utility pole 38 is placed. When the variable cam 6 is in the open position, the bezel 14 is substantially perpendicular to sidewall 22.

Figure 4B:
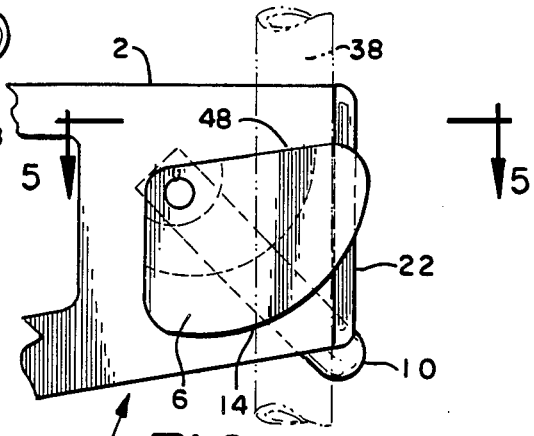
FIG. 4B is a detailed plan view showing the variable cam, rotating lever, utility pole and the utility pole receiving pocket cut along line 4—4 of FIG. 3 when the variable cam is in the closed position.

FIG. 4B is also a detailed plan view of the hospital utility pole clamp 20 cut along line 4—4 of FIG. 3. In FIG. 4B, variable cam 6 is shown in the closed position. Sidewall 22 and mounting plate 2 form the utility pole receiving pocket shown generally at 48. The utility pole 38 occupies receiving pocket 48. When variable cam 6 is in the closed position, it provides a secure frictional connection of utility pole 38 in receiving pocket 48. The weight of lever 10 holds variable cam 6 in place against utility pole 38 and provides the force which allows variable cam 6 to hold utility pole 38 within the receiving pocket 48. When the variable cam 6 is in the closed position, the bezel 14 is substantially perpendicular to the sidewall 22. However, bezel 14 is oriented in the substantially opposite direction when variable cam 6 is in the closed position as when it is in the open position. This arrangement makes the clamping of disparate sizes of pole possible.

Figure 5:
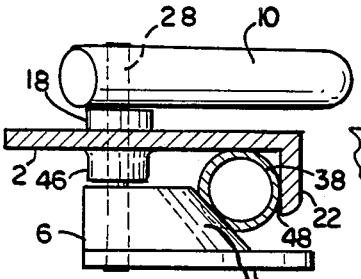
FIG. 5 is a cross-section view of the hospital utility pole clamp cut along line 5—5 of FIG. 4B showing the ellipsoidal solid and bezel which comprise the cam.

FIG. 5 is a cross-section view of the hospital utility pole clamp taken along line 5—5 of FIG. 4B. Referring now to FIG. 5, the sidewall 22 and mounting plate 2 form the utility pole receiving pocket 48. The pole receiving pocket is occupied by utility pole 38 which is frictionally held within the receiving pocket 48 by variable cam 6. The weight of lever 10 provides the force which allows cam 6 to hold pole 38 within pocket means 48 by friction. Resilient means may also be employed for this function.

In a preferred embodiment, lever 10 is attached to variable cam 6 by shaft means shown generally at 28. Shaft means 28 is conveniently placed through a sleeve 46 which is an integral part of mounting plate 2. A washer 18 provides the correct spacing between lever 10 and mounting plate 2 so that lever 10 is free to rotate in an unimpeded fashion. In a further preferred embodiment, variable cam 6 is comprised of a section of an ellipsoidal solid shown generally at 12 and a bezel 14. The section of the ellipsoidal solid 12 allows variable cam 6 to secure utility poles 38 of different diameters within receiving pocket 48. Bezel 14 surrounds the ellipsoidal solid section 12 and is an integral part of the ellipsoidal solid section 12. Bezel 14 is substantially parallel to mounting plate 2 and assists in securing a utility pole 38 with a large diameter within pole receiving pocket 48.

There has thus been described certain embodiments of the invention modified to serve as clamps for hospital utility poles. While preferred embodiments have been shown and described, modifications are within the spirit and scope of the invention.

What is claimed is:

1. A clamp for attaching a utility pole having a wheeled leg to a patient transportation vehicle such that the pole and the vehicle are moveable in tandem when so attached, the clamp comprising:

mounting means for attaching the clamp to the vehicle, the mounting means having a pocket for enclosing the utility pole;

a cam rotatably mounted to the mounting means in cooperative relationship to the pocket such that the cam is rotatable from an open position in which the cam does not substantially restrict access to the pocket, and a closed position in which the pocket is substantially closed by the cam; and leg guide means attached to said mounting means such that the wheeled leg of a utility pole is contained within the leg guide means when the utility pole is attached to the clamp.

2. A clamp according to claim 1, wherein the cam is a variable cam.

3. A clamp according to claim 1, wherein the pocket is comprised of two sides which are substantially perpendicular.

4. A clamp according to claim 1, wherein the cam is rotatable by a lever means.

5. A clamp according to claim 4, wherein the weight of the lever means secures the cam in an open or closed position.

6. A clamp according to claim 5, wherein the mounting means has a lever stop means attached to the mounting means such that the lever stop means is substantially perpendicular to the mounting means and the lever means rests against the lever stop means when the lever means is in the open position.

7. A clamp according to claim 1, wherein the cam is a section of an ellipsoidal solid.

8. A clamp according to claim 1, wherein the cam is comprised of a section of an ellipsoidal solid surrounded by a bezel.

* * * * *